US006357347B1

(12) United States Patent
Yoshida

(10) Patent No.: US 6,357,347 B1
(45) Date of Patent: Mar. 19, 2002

(54) STENCIL SHEET

(75) Inventor: Kenji Yoshida, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/599,744

(22) Filed: Jun. 23, 2000

(30) Foreign Application Priority Data

Jun. 25, 1999 (JP) ..... 11-179699

(51) Int. Cl.[7] ..... B41N 1/24
(52) U.S. Cl. ..... 101/128.21; 428/195
(58) Field of Search ..... 101/128.21, 128.4; 428/195

(56) References Cited

U.S. PATENT DOCUMENTS

| | | | | | |
|---|---|---|---|---|---|
| 4,550,660 | A | * | 11/1985 | Sato et al. | 101/128.21 |
| 4,981,746 | A | * | 1/1991 | Matsuo et al. | 428/195 |
| 5,089,341 | A | * | 2/1992 | Yoshimura et al. | 428/412 |
| 5,139,860 | A | * | 8/1992 | Mori | 428/264 |
| 5,665,442 | A | | 9/1997 | Andersen et al. | 428/36.4 |
| 5,830,548 | A | | 11/1998 | Andersen et al. | 428/36.4 |
| 5,908,687 | A | * | 6/1999 | Mori | 101/128.21 |

FOREIGN PATENT DOCUMENTS

| | | |
|---|---|---|
| JP | 51-4875 | 1/1976 |
| JP | 57-182495 | 11/1982 |
| JP | 58-147396 | 9/1983 |
| JP | 59-2896 | 1/1984 |
| JP | 59-16793 | 1/1984 |
| JP | 59-115898 | 7/1984 |
| JP | 2-67197 | 3/1990 |
| JP | 8-67080 | 3/1996 |

* cited by examiner

*Primary Examiner*—Stephen R. Funk
(74) *Attorney, Agent, or Firm*—Fitch, Even, Tabin & Flannery

(57) ABSTRACT

Stencil sheets which are inhibited from extension when printing of a large number of copies and from getting creases so that originals can be faithfully reproduced and sharp prints can be obtained are described. A stencil sheet can include a laminate of a thermoplastic resin film and a porous support mainly compose of synthetic fibers, and have a wet tensile strength in the longitudinal direction of 200 gf/cm or more, preferably 300 gf/cm or more and a breaking strength under shear in the longitudinal direction of 400 gf/cm$^2$ or more, preferably 600 gf/cm$^2$ or more. The thermoplastic resin film can have a thickness of 0.1–10 $\mu$m.

20 Claims, No Drawings

STENCIL SHEET

The present invention relates to a stencil sheet, and more particularly to a stencil sheet which does not expand even if it has been used for continuous printing of a large number of copies and can give sharp printed images faithful to originals.

Stencil sheets generally comprise a thermoplastic resin film such as polyester film, polyvinylidene chloride film or polypropylene film and a porous support of a thin paper, a nonwoven fabric or a gauze made of natural fibers or synthetic fibers, the film and the porous support being laminated to each other with an adhesive (JP-A-57-182495, JP-A-58-147396, JP-A-59-115898, etc.).

However, printed images obtained using these conventional stencil sheets (hereinafter sometimes referred to as "stencil printing sheets") are not necessarily satisfactory in sharpness of the printed images. Various causes are considered for the sharpness of the printed images being unsatisfactory, and one of them relates to the fibers constituting the porous support (hereinafter sometimes referred to as merely "supports"). That is, when the commonest thin paper comprising natural fibers is used as a porous support, passing of ink therethrough is apt to become uneven because the fibers are thick, non-uniform and flat. If ink is hindered from passing through perforations of the film, the prints are faded or voids are produced in the solid prints. Moreover, if large foreign matters coming from the natural fibers are not sufficiently removed at the production step of supports, these foreign matters hinder the passing of ink to cause generation of voids.

For the improvement of these defects, it has been proposed to use a thin paper made of natural fibers and synthetic fibers in admixture or a nonwoven fabric comprising thin synthetic fibers such as polyester fibers or polypropylene fibers as a porous support, thereby to reduce the basis weight of the fibers as much as possible (See, for example, JP-A-59-2896, JP-A-59-16793, and JP-A-2-67197).

Furthermore, for the improvement of sharpness of printed images, it is effective to enhance perforation sensitivity of the thermoplastic resin films, and for this purpose, a heat-sensitive stencil printing sheet comprising a film of thin thickness has been proposed.

However, if the fibers of the support are made thin, the basis weight is reduced or the thickness of the film is made thin, there are the following problems, namely, running property of the stencil sheet is deteriorated to cause jamming in the printing machine, and when the perforated sheet is wound around a printing drum, creases occur in the sheet (creasing at winding) to cause distortion or blurring of the printed images at the creasing portion, resulting in deterioration of sharpness of the printed images. Furthermore, in continuous printing of a large number of copies, expansion of the sheet occurs (expansion at printing) to cause decrease in reproducibility of original or creasing occurs during the printing (creasing at printing) to cause deterioration in sharpness of the printed images.

In order to solve these defects, it has been proposed to carry out printing with a stencil sheet having a given tensile strength in machine direction and a given flexural rigidity (JP-A-8-67080) and to carry out printing with a stencil sheet having a given wet elongation under a certain tensile load (JP-A-5-104875). These stencil sheets are satisfactory in that they are excellent in running property and creases hardly occur in winding around a printing drum, but are still not satisfactory in that they show expansion at printing and crease at printing, and are not sufficient in reproducibility of originals and sharpness of the printed images.

The object of the present invention is to solve the above problems in conventional techniques, and to provide a stencil printing sheet which is inhibited from expanding at printing of a large number of copies and from creasing at printing and thus can faithfully reproduce originals and give sharp prints.

The above object can be attained by a stencil sheet comprising a laminate of a thermoplastic resin film and a porous support mainly composed of a synthetic fiber, characterized in that the stencil sheet has a wet tensile strength in longitudinal direction of 200 gf/cm or more and a breaking strength under shear of 400 gf/cm$^2$ or more.

At the stencil printing, the printing paper in contact with the stencil sheet gives an external stress to the stencil sheet in the direction of the stencil sheet being expanded. This external stress is caused by back tension generated by printing paper feeding rollers. Under a certain external stress, the expansion at printing decreases with increase of wet tensile strength of the stencil sheet in longitudinal direction, and hence the greater wet tensile strength of the stencil sheet in longitudinal direction is preferred. If the wet tensile strength of the stencil sheet in longitudinal direction is less than 200 gf/cm, the expansion of the stencil sheet at printing is great and besides creases occur in the stencil sheet at printing to deteriorate reproducibility of originals. Moreover, the stencil sheet sometimes cannot be smoothly carried if the stencil sheet is insufficient in tensile strength because a tension is applied to the stencil sheet in the running direction during being carried in a printing machine. Furthermore, when the stencil sheet is wound around a printing drum, the stencil sheet creases. Therefore, in the present invention, the stencil sheet is needed to have a wet tensile strength in longitudinal direction of 200 gf/cm or more, preferably 300 gf/cm or more.

However, even in the case of stencil sheets of 200 gf/cm or more in wet tensile strength in longitudinal direction, some of them are great in expansion at printing or are apt to crease at printing depending on the kind of the stencil sheets. Therefore, the inventors have conducted intensive research on the mechanism of occurrence of expansion at printing and occurrence of creases at printing, and, as a result, it has been found that the heat-sensitive stencil printing sheets satisfying the above-mentioned wet tensile strength decrease in expansion at printing with increase of breaking strength under shear. That is, it has been found that if the breaking strength under shear in longitudinal direction of the stencil sheets is less than 400 gf/cm$^2$, creases occur at printing. Therefore, in the present invention, the stencil sheets are required to have a breaking strength under shear in longitudinal direction of 400 gf/cm$^2$ or more, preferably 600 gf/cm$^2$ or more.

Thus, according to the present invention, occurrence of expansion of the stencil sheet at printing of many copies can be inhibited and occurrence of creases at printing can also be inhibited and, hence, sharp printed images faithful to originals can be obtained by using a stencil sheet which satisfies simultaneously the above requirements of wet tensile strength and breaking strength under shear.

The stencil sheet of the present invention is formed by laminating a thermoplastic resin film and a porous support mainly composed of synthetic fibers and is needed to have the above-mentioned wet tensile strength and breaking strength under shear. The "longitudinal direction" in the present invention means the peripheral direction when the sheet is wound around a drum, and is usually the same as the longer direction of a roll stencil sheet and the running direction in the stencil printing apparatus.

As the thermoplastic resin films used in the present invention, there are used those which are suitable for thermal perforation by a thermal head or the like, and examples are conventionally known films such as those of polyester, polyamide, polypropylene, polyethylene, polyvinyl chloride, polyvinylidene chloride and copolymers thereof. From the point of perforation sensitivity, polyester films are preferred.

As the polyesters, there may be preferably used polyethylene terephthalate, copolymer of ethylene terephthalate and ethylene isophthalate, polyethylene-2,6-naphthalate, polyhexamethylene terephthalate, copolymer of hexamethylene terephthalate and 1,4-cyclohexanedimethylene terephthalate, etc.

The thermoplastic resin films are preferably those which are stretched, and these can be produced by known T-die extrusion method, inflation method, etc. For example, a polymer is extruded on a casting drum by T-die extrusion method to produce an unstretched film, and this is longitudinally stretched by a group of heating rolls, and, if necessary, can be transversely stretched by feeding the film to a tenter. The unstretched film of a desired thickness can be prepared by adjusting slit width of spinneret, discharging amount of polymer and revolving number of the casting drum, and, furthermore, the stretching can be performed at a desired stretching ratio by adjusting the revolving speed of the heating rolls or changing the width of the tenter.

Moreover, if necessary, the thermoplastic resin films can contain flame retardants, heat stabilizers, antioxidants, ultraviolet absorbers, antistatic agents, pigments, dyes, organic lubricants such as fatty acid esters and waxes, anti-foaming agents such as polysiloxane, etc.

Thickness of the thermoplastic resin films is usually 0.1–10 $\mu$m, preferably 0.1–5 $\mu$m, more preferably 0.1–3 $\mu$m. If the thickness exceeds 10 $\mu$m, perforation property sometimes deteriorates, and if it is less than 0.1 $\mu$m, film-forming stability sometimes deteriorates.

Examples of the synthetic fibers used for the porous support are conventionally known fibers such as of polyester, polyamide, polyphenylene sulfide, polyacrylonitrile, polypropylene, polyethylene and copolymers thereof. These synthetic fibers may be used each alone or in combination of two or more, and, furthermore, may contain natural fibers or regenerated fibers. In the present invention, polyester fibers are especially preferred from the point of heat stability at perforation. Examples of the polyesters used as the synthetic fibers are polyethylene terephthalate, polyethylene naphthalate, polycyclohexanedimethylene terephthalate, and copolymer of ethylene terephthalate and ethylene isophthalate.

The porous support used in the present invention is produced mainly from the above synthetic fibers, and may be a paper, nonwoven fabric or woven fabric made from these short fibers. The nonwoven fabric is preferred.

The nonwoven fabric can be obtained by conventionally known direct melt spinning methods such as flash spinning method, melt-blow spinning method and spun bonding method. For example, according to the melt-blow method, a molten polymer is discharged from a spinneret with blowing a hot air against the discharged polymer from the circumference of the spinneret to make finer the discharged polymer with the hot air, and then the spun fibers are collected by blowing onto a net conveyor disposed at a predetermined position to make a web. Since the web is sucked together with the hot air by a suction device provided at the net conveyor, the fibers are collected before they are completely coagulated. That is, the fibers of the web are collected in the state of fusing with each other. The breaking strength under shear can be adjusted by suitably setting the distance for collection of the fibers between the spinneret and the net conveyor. Furthermore, basis weight of the web and single fiber diameter can be optionally set by suitably adjusting the amount of the polymer discharged, the hot air temperature, the flow rate of the hot air and the moving speed of the conveyor. The distance for collection of the fibers is preferably 30 cm or less. If the distance is more than 30 cm, the fusion bonding of the fibers is weak and sometimes a sufficient strength as a support cannot be obtained.

The fibers spun by melt-blow method are made finer by the pressure of the hot air and set in non-oriented or low-oriented state. Thickness of the fibers is not uniform, and the web is formed in such a state that thick fibers and thin fibers are properly dispersed. Moreover, the polymer discharged from the spinneret is rapidly cooled from molten state to an atmosphere of room temperature, and hence is set in the low-crystallization state close to amorphous state.

In order to give affinity for ink to the porous support, the surface of the fibers may be subjected to chemical treatment with acid or alkali, corona treatment or low temperature plasma treatment.

Average fiber diameter of the porous support is preferably 2–15 $\mu$m. If the average fiber diameter is less than 2 $\mu$m, the stencil sheet is apt to crease and to leave unperforated portions. If it is more than 15 $\mu$m, ink is apt to pass unevenly.

Furthermore, basis weight of the fibers of the porous support is usually 2–30 g/m$^2$, preferably 2–20 g/m$^2$, more preferably 5–15 g/m$^2$. If the basis weight exceeds 30 g/m$^2$, passing property of ink is deteriorated and sharpness of the images is apt to decrease. If the basis weight is less than 2 g/m$^2$, sometimes sufficient strength as a support cannot be obtained.

The stencil sheet of the present invention is obtained by laminating and integrating the above-mentioned thermoplastic resin film and porous support mainly composed of synthetic fibers. The lamination of the thermoplastic resin film and the porous support can be performed by a method of bonding them with adhesives under the conditions not to deteriorate the perforation sensitivity, a method of heat-bonding the film and the support with using no adhesives, etc. From the point of sharpness of the printed images, preferred is a method of directly bonding the thermoplastic resin film and the porous support by heat-bonding with using no adhesives.

The heat-bonding is usually carried out by hot-pressing which comprises directly laminating the thermoplastic resin film and the porous support under heating. The method of hot-pressing is not limited, but the hot-pressing by heating roll is preferred from the point of processability. The bonding temperature is usually 80–170° C., preferably 100–150° C.

In the present invention, it is especially preferred to co-stretch an unstretched thermoplastic resin film and a porous support of low orientation degree in heat-bonded state. By co-stretching them in heat-bonded state, the film and the nonwoven fabric can be integrally stretched with causing no separation of them. In this case, since the fibers of the nonwoven fabric are stretched in fusion bonded state at their entangling points, a reticulation suitable as a support can be formed. Furthermore, by integrally stretching them, the thermoplastic resin film and the porous support are directly bonded and can be integrated without using adhesives.

The tensile strength and the breaking strength under shear of the stencil sheet can be specified within the ranges of the present invention by suitably adjusting the kind of the polymers of the film and the fibers of the support used, basis weight of the support, temperature for co-stretching, stretching ratio, and nip pressure.

The method of co-stretching is not limited, but biaxial stretching is preferred and may be either sequential biaxial stretching or simultaneous biaxial stretching. The sequential biaxial stretching is generally carried out in sequence of longitudinal direction and transverse direction, but may be carried out in reverse sequence. Moreover, after biaxial stretching, re-stretching may be carried out in longitudinal or transverse direction or simultaneously in longitudinal and transverse directions. Stretching temperature is preferably 50–150° C., more preferably 60–130° C. Furthermore, it is preferred to carry out a heat treatment after the biaxial stretching. The heat treating temperature is not restricted, and can be suitably determined depending on the kind of the thermoplastic resins used.

In the present invention it is preferred to coat the film surface of the stencil sheet with a releasing agent for the inhibition of sticking of a thermal head to the surface at the time of perforation. As the releasing agent, there may be conventionally known agents comprising silicone oil, silicone resin, fluorine-based resin, surface active agent, or the like. Furthermore, the releasing agents may contain various additives such as antistatic agent, heat resisting agent, antioxidant, organic particle, inorganic particle and pigment in combination.

The stencil sheet of the present invention is used typically in the following manner. First, when an original is set in the reading unit of a printing machine, a reading sensor reads light and shade corresponding to the figures and letters of the original as digital signals and transmits the signals to the thermal head. On the other hand, the roll stencil sheet set in a holder is carried to the thermal head by carrying rollers and perforated by heading with the thermal head. The top end of the perforated stencil sheet is held by a clamping unit of a printing drum and is wound around the printing drum. Ink is squeezed out from the inside of the printing drum and transferred to a printing paper through the perforations of the stencil sheet to complete the stencil printing. The printing paper is fed synchronously with the rotation of the printing drum, and the number of copies desired are continuously printed.

The present invention will be explained in more detail by the following nonlimiting examples. The properties of the stencil sheet in the examples were measured by the following methods.

(1) Wet tensile strength in longitudinal direction of stencil sheet (gf/cm):

The stencil sheet was cut in longitudinal direction by a single-edged razor to prepare ten samples of 15 mm in width and 150 mm in length. Then, the sample was dipped in water to be well wetted. Thereafter, it was pulled until it broke at a testing speed of 10 mm/min by a universal testing machine ("AUTOGRAPH AGS-D" manufactured by Shimadzu Seisakusho Ltd.) with the testing length being 100 mm, and the load when it extended by 2% (2 mm) was divided by the width of the sample to obtain the strength. Average tensile strength of the ten samples was obtained and this was taken as the wet tensile strength in longitudinal direction.

(2) Breaking strength under shear of stencil sheet:

A stencil sheet was cut in longitudinal direction to 50 mm in width and 25 mm in length, and metal sheets were adhered to both sides of the stencil sheet using double-coated tapes of the same size as above to prepare a sample for measurement. The measurement was carried out in the following manner using a universal testing machine ("AUTOGRAPH AGS-D" manufactured by Shimadzu Seisakusho Ltd.). One of the metal sheets of the sample was pulled upwardly and another was pulled downwardly at a testing speed of 50 mm/min in longitudinal direction of the stencil sheet to cause shear breaking of the stencil sheet. The maximum load was divided by the area of the sample to obtain a strength. The measurement was carried out five times, and the average value was obtained and this was taken as breaking strength under shear in longitudinal direction of the stencil sheet.

(3) Average fiber diameter of support ($\mu$m):

Optional 10 portions of the nonwoven fabric were photographed by an electron microscope (SEM), and diameters of optional 15 fibers in one photograph were measured. This measurement was carried out for ten photographs to measure diameters of 150 fibers in total and the average value thereof was taken as the average fiber diameter.

(4) Basis weight of support:

weight of the stencil sheet was measured by a precision scale and converted to a weight per $m^2$. Weight of the film was deducted from the resulting weight of the sheet to obtain the basis weight.

(5) Evaluation of expansion at printing:

The stencil sheet was fed to a stencil printing machine RISOGRAPH GR377 (trade mark) manufactured by Riso Kagaku Corporation and perforated using an original of lattice design, followed by carrying out printing. A distance between optional two points in machine direction in the print was measured, and ratio of the distance in the 1000th print to the distance in the 1st print was obtained, and the results were evaluated by the following criteria.

◎: Very good (the ratio was less than 0.1%).

○: Good (the ratio was 0.1% or more and less than 0.4%).

Δ: Practically acceptable (the ratio was 0.4% or more and less than 0.8%).

X: Practically unacceptable (the ratio was 0.8% or more).

(6) Evaluation of creasing at printing:

The state of the stencil sheet on the printing drum after printing of 1000 prints was visually evaluated, and the results were graded by the following criteria.

○: No creases occurred.

Δ: Minute creases occurred, but the sheet was practically acceptable.

X: Creases occurred to cause deterioration in sharpness of printed images and the sheet was practically unacceptable.

EXAMPLE 1

Polyethylene terephthalate ($\eta$=0.61, Tm=254° C.) was spun by a melt blow method, and the resulting fibers were dispersed and collected on a conveyor at a collection distance of 20 cm to prepare a nonwoven fabric having a basis weight of 120 g/$m^2$ and an average fiber diameter of 8.0 $\mu$m.

Then, a copolymer polyester resin ($\eta$=0.65, Tm=210° C.) comprising 85 mol % of polyethylene terephthalate and 15 mol % of polyethylene isophthalate was extruded using an extruder, and cast on a cooling drum to prepare an unstretched film. The nonwoven fabric obtained above was superposed on the unstretched film, and these were fed to heating rollers to perform heat-contact bonding of them to obtain a laminate sheet.

The laminate sheet was stretched 3.5 times in machine direction by stretching rollers at 90° C., and then fed into a tenter type stretching machine to stretch the sheet 3.5 times in crosswise direction at a stretching temperature of 90° C., and, furthermore, heat-treated at 140° C. in the tenter. A wax releasing agent was coated on the film surface at the inlet part of the stretching machine by a gravure coater at a dry weight of 0.1 g/m$^2$ to obtain a stencil sheet.

In the resulting stencil sheet, basis weight of the support was 10 g/m$^2$, average fiber diameter of the support was 4.0 $\mu$m, thickness of the film was 1.5 $\mu$m, wet tensile strength in longitudinal direction was 305 gf/cm, and breaking strength under shear was 411 gf/cm$^2$.

EXAMPLE 2

A stencil sheet was prepared in the same manner as in Example 1, except that the stretching temperature was 100° C. in both the machine and crosswise directions. In the resulting stencil sheet, basis weight of the support was 10 g/m$^2$, average fiber diameter of the support was 4.0 $\mu$m, thickness of the film was 1.5 $\mu$m, wet tensile strength in longitudinal direction was 313 gf/cm, and breaking strength under shear was 608 gf/cm$^2$.

EXAMPLE 3

A nonwoven fabric having a basis weight of 85 g/m$^2$ and an average fiber diameter of 8.0 $\mu$m was prepared in the same manner as in Example 1. A stencil sheet was prepared using the nonwoven fabric in the same manner as in Example 1. In the resulting stencil sheet, basis weight of the support was 7.0 g/m$^2$, average fiber diameter of the support was 4.0 $\mu$m, thickness of the film was 1.5 $\mu$m, wet tensile strength in longitudinal direction was 206 gf/cm, and breaking strength under shear was 402 gf/cm$^2$.

EXAMPLE 4

A nonwoven fabric having a basis weight of 85 g/m$^2$ and an average fiber diameter of 8.0 $\mu$m was prepared in the same manner as in Example 1, except that the collection distance of the fibers was 15 cm. A stencil sheet was prepared using the resulting nonwoven fabric in the same manner as in Example 1. In the resulting stencil sheet, basis weight of the support was 7.0 g/m$^2$, average fiber diameter of the support was 4.0 $\mu$m, thickness of the film was 1.5 $\mu$m, wet tensile strength in longitudinal direction was 210 gf/cm, and breaking strength under shear was 617 gf/cm$^2$.

EXAMPLE 5

In the same manner as in Example 1, polyethylene terephthalate copolymerized with 15 mol % of polyethylene isophthalate was extruded on a casting drum using an extruder, followed by biaxial stretching threefold in lengthwise direction and threefold in crosswise direction to prepare a polyester film of 1.7 $\mu$m in thickness. This polyester film and a thin paper having a basis weight of 8.2 gm$^2$ and made from a mixture of 70% of Manila hemp and 30% of polyester fibers were bonded with a polyvinyl acetate resin interposed between the film and the paper, followed by coating a silicone releasing agent at 0.1 g/m$^2$ on the film surface to obtain a stencil sheet. The resulting stencil sheet had a wet tensile strength in longitudinal direction of 213 gf/cm and a breaking strength under shear of 407 gf/cm$^2$.

Comparative Example 1

A nonwoven fabric having a basis weight of 85 g/m$^2$ and an average fiber diameter of 8.0 $\mu$m was prepared in the same manner as in Example 1. A stencil sheet was prepared using the resulting nonwoven fabric in the same manner as in Example 1, except that the stretching temperature was 85° C. in both the machine and crosswise directions. In the resulting stencil sheet, basis weight of the support was 7.0 g/m$^2$, average fiber diameter of the support was 4.0 $\mu$m, thickness of the film was 1.5 $\mu$m, wet tensile strength in longitudinal direction was 203 gf/cm, and breaking strength under shear was 317 gf/cm$^2$.

Comparative Example 2

A nonwoven fabric having a basis weight of 120 g/m$^2$ and an average fiber diameter of 8.0 $\mu$m was prepared in the same manner as in Example 1. A stencil sheet was prepared using the resulting nonwoven fabric in the same manner as in Example 1, except that the stretching temperature was 100° C. in both the machine and crosswise directions and the stretching ratio was 2.7 times in machine direction and 4.5 times in crosswise direction. In the resulting stencil sheet, basis weight of the support was 10 g/m$^2$, average fiber diameter of the support was 4.0 $\mu$m, thickness of the film was 1.5 $\mu$m, wet tensile strength in longitudinal direction was 153 gf/cm, and breaking strength under shear was 610 gf/cm$^2$.

Comparative Example 3

A nonwoven fabric having a basis weight of 120 g/m$^2$ and an average fiber diameter of 8.0 $\mu$m was prepared in the same manner as in Example 1. A stencil sheet was prepared using the resulting nonwoven fabric in the same manner as in Example 1, except that the stretching temperature was 85° C. in both the machine and crosswise directions. In the resulting stencil sheet, basis weight of the support was 10 g/m$^2$, average fiber diameter of the support was 4.0 $\mu$m, thickness of the film was 1.5 $\mu$m, wet tensile strength in longitudinal direction was 302 gf/cm, and breaking strength under shear was 313 gf/cm$^2$.

TABLE 1

| | Film thickness $\mu$m | Fiber diameter of support $\mu$m | Basis weight of support g/m$^2$ | Wet tensile strength in longitudinal direction gf/cm | Breaking strength under shear gf/cm$^2$ | Expansion at printing | Creasing at printing |
|---|---|---|---|---|---|---|---|
| Example 1 | 1.5 | 4.0 | 10.0 | 305 | 411 | ○ | ○ |
| Example 2 | 1.5 | 4.0 | 10.0 | 313 | 608 | ◎ | ○ |
| Example 3 | 1.5 | 4.0 | 7.0 | 206 | 402 | Δ | Δ |
| Example 4 | 1.5 | 4.0 | 7.0 | 210 | 617 | ○ | ○ |
| Example 5 | 1.7 | Not measured | 8.2 | 213 | 407 | Δ | Δ |
| Comparative Example 1 | 1.5 | 4.0 | 7.0 | 203 | 317 | x | x |

TABLE 1-continued

| | Film thickness μm | Fiber diameter of support μm | Basis weight of support g/m$^2$ | Wet tensile strength in longitudinal direction gf/cm | Breaking strength under shear gf/cm$^2$ | Expansion at printing | Creasing at printing |
|---|---|---|---|---|---|---|---|
| Comparative Example 2 | 1.5 | 4.0 | 10.0 | 153 | 610 | x | x |
| Comparative Example 3 | 1.5 | 4.0 | 10.0 | 302 | 313 | Δ | x |

As can be seen from Table 1, since the stencil sheets of Examples 1–5 had a wet tensile strength in longitudinal direction of 200 gf/cm or greater and a breaking strength under shear of 400 gf/cm$^2$ or greater, expansion was inhibited even at printing of a large number of copies, creases did not occur at printing, and reproducibility of originals in prints was superior.

Since the stencil sheet of the present invention has a wet tensile strength in longitudinal direction and a breaking strength under shear of more than given values, expansion of the sheet at printing of a large number of copies can be inhibited, further, creasing at printing can be inhibited, and as a result, reproducibility of originals is excellent and sharp prints can be obtained.

What is claimed is:

1. A stencil sheet comprising a laminate of a thermoplastic resin film and a porous support composed of synthetic fibers, wherein said stencil sheet has a wet tensile strength in the longitudinal direction of 200 gf/cm or more and a breaking strength under shear in the longitudinal of 400 gf/cm$^2$ or more.

2. A stencil sheet according to claim 1, in which said thermoplastic resin film has a thickness of 0.1–10 μm.

3. A stencil sheet according to claim 1, in which said thermoplastic resin film has a thickness of 0.1–5 μm.

4. A stencil sheet according to claim 1, in which said thermoplastic resin film has a thickness of 0.1–3 μm.

5. A stencil sheet according to claim 1, in which said wet tensile strength is 300 gf/cm or more.

6. A stencil sheet according to claim 1, in which said breaking strength under shear is 600 gf/cm$^2$ or more.

7. A stencil sheet according to claim 1, in which said porous support comprises a nonwoven fabric and the nonwoven fabric is heat-bonded to said thermoplastic resin film.

8. A stencil sheet comprising a thermoplastic resin film and a porous support consisting essentially of synthetic fibers, wherein said stencil sheet has a wet tensile strength in the longitudinal direction of at least 300 cf/cm and a breaking strength under shear in the longitudinal direction of at least 600 cf/cm$^2$.

9. A stencil sheet according to claim 8, in which said thermoplastic resin film has a thickness of 0.1–10 μm.

10. A stencil sheet according to claim 8, in which said thermoplastic resin film has a thickness of 0.1–5 μm.

11. A stencil sheet according to claim 8, in which said thermoplastic resin film has a thickness of 0.1–3 μm.

12. A stencil sheet according to claim 8, wherein the synthetic fibers in said porous support have an average fiber diameter of 2–15 μm.

13. A stencil sheet according to claim 8, wherein said synthetic fibers in said porous support have a basis weight of 2 to 30 g/m$^2$.

14. A stencil sheet according to claim 8, wherein said synthetic fibers in said porous support have a basis weight of 5 to 15 g/m$^2$.

15. A stencil sheet according to claim 8, wherein said thermoplastic resin film comprises a polyester film.

16. A stencil sheet according to claim 15, wherein said porous support and said thermoplastic resin film are integrally co-stretched while being heat bonded.

17. A stencil sheet according to claim 8, wherein said porous support comprises a non-woven fabric, which non-woven fabric is heat-bonded to said thermoplastic resin film.

18. A stencil sheet comprising a laminate of a thermoplastic resin film and a porous support of fibers, wherein said stencil sheet has a wet tensile strength in the longitudinal direction of 200 gf/cm or more and a breaking strength under shear in the longitudinal of 400 gf/cm$^2$ or more.

19. A stencil sheet according to claim 18, wherein said stencil sheet is obtained by preparing an unstretched thermoplastic resin film, placing said porous support on one side of said unstretched thermoplastic resin film, heat-contact bonding them together, and co-stretching the heat-contact-bonded thermoplastic resin film and porous support.

20. A stencil sheet according to claim 18, wherein said stencil sheet is obtained by preparing a biaxially stretched thermoplastic resin film, and using another resin to adhere one side of said biaxially stretched thermoplastic resin film to said porous support.

* * * * *